US010767494B2

(12) United States Patent
Hillier

(10) Patent No.: US 10,767,494 B2
(45) Date of Patent: Sep. 8, 2020

(54) CMC AEROFOIL

(71) Applicant: ROLLS-ROYCE plc, London (GB)

(72) Inventor: Steven Hillier, Manchester (GB)

(73) Assignee: Rolls-Royce plc, London ( * ) Notice: Subject to any disclaimer, the term of this patent is extended or adjusted under 35 U.S.C. 154(b) by 12 days.

(21) Appl. No.: 16/379,925

(22) Filed: Apr. 10, 2019

(65) Prior Publication Data

US 2019/0330988 A1 Oct. 31, 2019

(30) Foreign Application Priority Data

Apr. 25, 2018 (GB) ..... 1806774.4

(51) Int. Cl.

| | |
|---|---|
| ***F01D 25/12*** | (2006.01) |
| ***F01D 5/18*** | (2006.01) |
| ***F01D 5/28*** | (2006.01) |
| ***B28B 23/00*** | (2006.01) |

(52) U.S. Cl.

CPC ..... *F01D 5/188* (2013.01); *B28B 23/00* (2013.01); *F01D 5/284* (2013.01); *F01D 25/12* (2013.01); *F05D 2220/32* (2013.01); *F05D 2230/31* (2013.01); *F05D 2250/61* (2013.01); *F05D 2250/711* (2013.01); *F05D 2250/712* (2013.01); *F05D 2300/6033* (2013.01); *F05D 2300/612* (2013.01)

(58) Field of Classification Search

None

See application file for complete search history.

(56) References Cited

U.S. PATENT DOCUMENTS

| | | | | |
|---|---|---|---|---|
| 6,451,416 | B1 * | 9/2002 | Holowczak | B32B 18/00 428/293.4 |
| 2005/0238491 | A1 * | 10/2005 | Morrison | F01D 5/282 416/229 R |
| 2006/0228211 | A1 * | 10/2006 | Vance | F01D 5/147 415/200 |
| 2006/0285973 | A1 * | 12/2006 | Keller | F01D 5/147 416/97 R |
| 2007/0048144 | A1 * | 3/2007 | Morrison | C04B 41/009 416/224 |
| 2008/0124512 | A1 * | 5/2008 | Steibel | C04B 35/573 428/105 |
| 2008/0203236 | A1 * | 8/2008 | Mazzola | F01D 5/18 244/35 R |

(Continued)

FOREIGN PATENT DOCUMENTS

EP 2599959 6/2013

OTHER PUBLICATIONS

Great Britain search report dated Oct. 9, 2018, issued in GB Patent Application No. 1806774.4.

*Primary Examiner* — Michael Lebentritt

(74) *Attorney, Agent, or Firm* — Barnes & Thornburg LLP

(57) ABSTRACT

The disclosure relates to a ceramic matrix composite (CMC) aerofoil. Example embodiments include an aerofoil comprising first and second tubular CMC cores (302, 303) extending along a longitudinal axis of the aerofoil; and an outer CMC layer surrounding the first and second tubular CMC cores (302, 303) and defining an outer shape of the aerofoil having leading and trailing edges, wherein fibres within a wall of the second tubular CMC core extend to the trailing edge of the aerofoil.

20 Claims, 18 Drawing Sheets

(56) References Cited

U.S. PATENT DOCUMENTS

| | | | | |
|---|---|---|---|---|
| 2010/0068034 | A1* | 3/2010 | Schiavo | F01D 5/282 415/115 |
| 2013/0142660 | A1* | 6/2013 | McCaffrey | F01D 5/18 416/241 B |
| 2016/0101561 | A1* | 4/2016 | Walston | B23K 1/0018 428/34.6 |
| 2016/0258320 | A1* | 9/2016 | Thomas | F01D 9/041 |
| 2016/0348513 | A1* | 12/2016 | Weaver | F01D 5/188 |
| 2017/0175534 | A1* | 6/2017 | Ferber | F01D 5/187 |
| 2017/0328216 | A1 | 11/2017 | Gallier | |
| 2018/0065337 | A1* | 3/2018 | Grasso | F01D 5/284 |
| 2018/0171806 | A1* | 6/2018 | Freeman | F01D 5/282 |
| 2018/0363475 | A1* | 12/2018 | de Diego | F01D 5/284 |
| 2019/0145269 | A1* | 5/2019 | Campbell | F01D 9/041 416/223 R |
| 2019/0284938 | A1* | 9/2019 | Senile | F01D 9/041 |
| 2020/0063581 | A1* | 2/2020 | Vetters | F01D 9/041 |

* cited by examiner

CMC AEROFOIL

CROSS-REFERENCE TO RELATED APPLICATIONS

This application is based upon and claims the benefit of priority from British Patent Application No. GB 1806774.4, filed on 25 Apr. 2018, the entire contents of which are incorporated by reference.

BACKGROUND

Technical Field

The present disclosure concerns a ceramic matrix composite (CMC) aerofoil.

Description of the Related Art

Ceramic matrix composites, which comprise ceramic fibres embedded in a ceramic matrix, exhibit a combination of properties that make them promising candidates for industrial applications that demand excellent thermal and mechanical properties along with low weight, such as gas turbine engine components. Existing CMCs and turbine engine components systems have various shortcomings, however, such as difficulties functioning at high temperatures without sacrificing structural stability. As CMC parts see increasing use as replacements for current metallic components in turbine engines, CMC-compatible cooling techniques are becoming increasingly important. Various cooling schemes have been attempted for CMC components, such as the placement of a series of continuous tubes into the fibrous preform of the composite during fabrication. It would be advantageous to develop a CMC component with integral cooling capabilities that can maintain a more uniform operating temperature, particularly for complex geometric parts.

SUMMARY

According to a first aspect there is provided an aerofoil comprising:

- first and second tubular CMC cores extending along a longitudinal axis of the aerofoil; and
- an outer CMC layer surrounding the first and second tubular CMC cores and defining an outer shape of the aerofoil having leading and trailing edges,
- wherein fibres within a wall of the second tubular CMC core extend to the trailing edge of the aerofoil.

Having fibres within a wall of the second tubular CMC core extending the trailing edge of the aerofoil allows air cooling channels to be positioned closer to the trailing edge of the aerofoil than would otherwise be possible, while maintaining a minimum radius of curvature for the internal tubular CMC cores.

The aerofoil may comprise one or more air cooling passages connecting an inner volume of the second tubular CMC core to an external surface of the aerofoil.

The aerofoil may comprise an inner concave external surface and an outer convex external surface, a plurality of air cooling passages connecting the inner volume of the second tubular CMC core to the inner concave external surface.

A plurality of air cooling passages may pass through a wall of the second tubular CMC core.

One or more air cooling passages may be defined by one or more gaps between adjacent facing portions of the inner surface of the second tubular CMC core.

The aerofoil may comprise an insert between the adjacent facing portions of the inner surface of the second tubular CMC core. A plurality of air cooling passages may be defined by passages within the insert. The insert may comprise ceramic foam, which may be open or closed celled. The insert may comprise plenums forming the plurality of air cooling passages.

A plurality of air cooling passages may be defined by corrugations of the inner surface of the second tubular CMC core.

According to a second aspect there is provided a method of forming a CMC aerofoil, comprising the steps of:

- providing first and second tubular CMC cores;
- surrounding the first and second tubular CMC cores with an outer CMC layer to define an outer shape of the aerofoil having leading and trailing edges, wherein fibres within a wall of the second tubular CMC core extend to the trailing edge of the aerofoil; and
- consolidating the first and second CMC cores with the outer CMC layer to form the CMC aerofoil.

The method may comprise the step of forming one or more air cooling passages connecting an inner volume of the second tubular CMC core to an external surface of the aerofoil.

The aerofoil may comprise an inner concave external surface and an outer convex external surface, the method comprising forming a plurality of air cooling passages connecting the inner volume of the second tubular CMC core to the inner concave external surface.

The method may comprise forming a plurality of air cooling passages passing through a wall of the second tubular CMC core.

The one or more air cooling passages may be defined by one or more gaps between adjacent facing portions of the inner surface of the second tubular CMC core.

The method may comprise providing an insert between the adjacent facing portions of the inner surface of the second tubular CMC core.

The method may comprise forming a plurality of air cooling passages by corrugations of the inner surface of the second tubular CMC core.

A plurality of air cooling passages may be defined by passages within the insert. The insert may comprise a ceramic foam, which can be open or closed celled. The insert may comprise plenums forming the plurality of air cooling passages.

The skilled person will appreciate that, except where mutually exclusive, a feature described in relation to any one of the above aspects may be applied mutatis mutandis to any other aspect. Furthermore except where mutually exclusive any feature described herein may be applied to any aspect and/or combined with any other feature described herein.

DESCRIPTION OF THE DRAWINGS

Embodiments will now be described by way of example only, with reference to the Figures, in which.

DETAILED DESCRIPTION

US 2016/0101561 A1 discloses a dual-walled CMC component comprising a CMC core having a hollow shape enclosing at least one interior channel and a CMC outer layer overlying and spaced apart from the CMC core by a ceramic slurry-cast architecture positioned therebetween. The CMC core further includes a plurality of through-thickness inner cooling holes in fluid communication with the at least one interior channel. The ceramic slurry-cast architecture defines a cooling fluid path over an outer surface of the CMC core that connects the interior channel (s) to an external environment of the dual-walled CMC component. The CMC outer layer may also include a plurality of through-thickness outer cooling holes in fluid communication with the cooling fluid path, thereby extending the cooling fluid path through the CMC outer layer.

Figure 1:
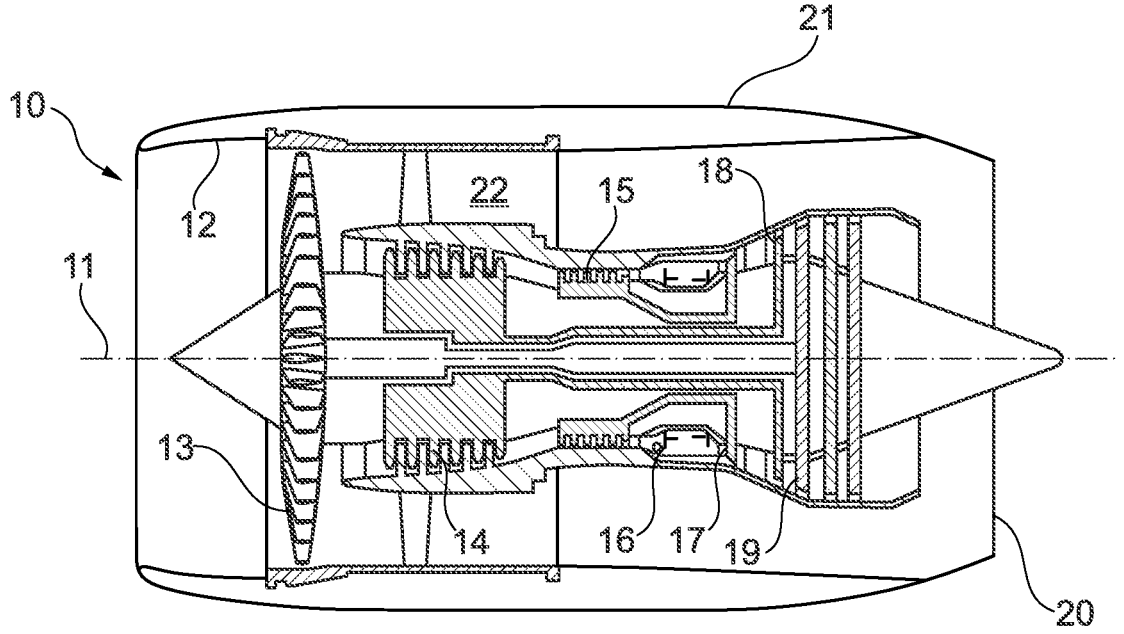
FIG. 1 is a sectional side view of a gas turbine engine.

A particular issue with aerofoil components, for example those used for vanes or blades in high temperature portions of a gas turbine engine, relates to cooling of the trailing edge of the aerofoil. With existing designs for CMC aerofoils, the geometry requirements for internal core components may restrict the ability to incorporate cooling passages that extend close to the trailing edge of the aerofoil. The requirement for a minimum internal radius for an internal core component for the aerofoil may result in either a less sharp trailing edge, resulting in poorer aerodynamic performance (and hence reduced efficiency), or in a greater distance between the internal volume of the core closest to the trailing edge (used to carry cooling air) resulting in an increase in temperature at the trailing edge of the aerofoil. To maximise use of the material it would be beneficial to enable the temperature distribution throughout the aerofoil to be as uniform as possible With reference to FIG. 1, a gas turbine engine is generally indicated at 10, having a principal and rotational axis 11. The engine 10 comprises, in axial flow series, an air intake 12, a propulsive fan 13, an intermediate pressure compressor 14, a high-pressure compressor 15, combustion equipment 16, a high-pressure turbine 17, an intermediate pressure turbine 18, a low-pressure turbine 19 and an exhaust nozzle 20. A nacelle 21 generally surrounds the engine 10 and defines both the intake 12 and the exhaust nozzle 20.

The gas turbine engine 10 works in the conventional manner so that air entering the intake 12 is accelerated by the fan 13 to produce two air flows: a first air flow into the intermediate pressure compressor 14 and a second air flow which passes through a bypass duct 22 to provide propulsive thrust. The intermediate pressure compressor 14 compresses the air flow directed into it before delivering that air to the high pressure compressor 15 where further compression takes place.

The compressed air exhausted from the high-pressure compressor 15 is directed into the combustion equipment 16 where it is mixed with fuel and the mixture combusted. The resultant hot combustion products then expand through, and thereby drive the high, intermediate and low-pressure turbines 17, 18, 19 before being exhausted through the nozzle 20 to provide additional propulsive thrust. The high 17, intermediate 18 and low 19 pressure turbines drive respectively the high pressure compressor 15, intermediate pressure compressor 14 and fan 13, each by suitable interconnecting shaft.

Other gas turbine engines to which the present disclosure may be applied may have alternative configurations. By way of example such engines may have an alternative number of interconnecting shafts (e.g. two) and/or an alternative number of compressors and/or turbines. Further the engine may comprise a gearbox provided in the drive train from a turbine to a compressor and/or fan.

Figure 2:
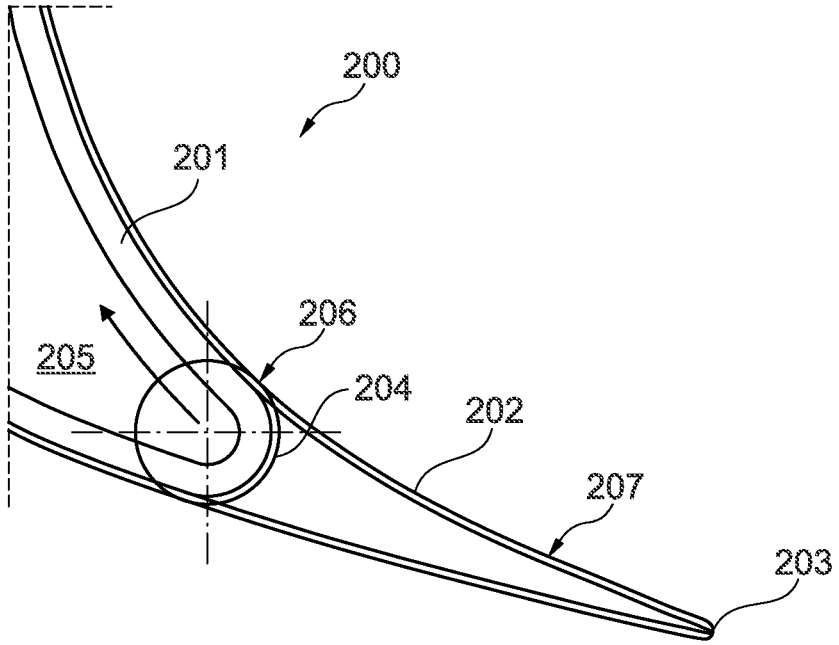
FIG. 2 is schematic sectional view of a trailing edge portion of a CMC aerofoil, in which a minimum internal radius is used.

FIG. 2 shows a sectional view of a trailing edge portion of an aerofoil 200 comprising a CMC core 201 and an outer CMC layer 202. The outer layer 202 extends beyond the inner CMC core 201 due to the need to have a minimum internal radius for the core 201, indicated in FIG. 2 by an outer diameter 206 of the core 201. As the wall thickness of the core 201 increases, the distance between the trailing edge 203 of the aerofoil and the trailing edge 204 of the internal core 201 increases. This affects the ability to cool the trailing edge 203 of the aerofoil, as any cooling air will first pass along the internal volume 205 of the internal core 201 before exiting through the outer layer, possibly via holes machined through the wall of the internal core 201 and the outer layer 202. Such holes can only extend as far as the extent of the internal core 201, resulting in cooling air exiting the holes having to travel along the outer surface (typically along the inner face 207 of the aerofoil) before reaching the trailing edge 203. The longer the distance this cooling air has to travel, the less cooling effect it is able to have on the trailing edge 203, which will consequently be at a higher temperature.

Figure 3:
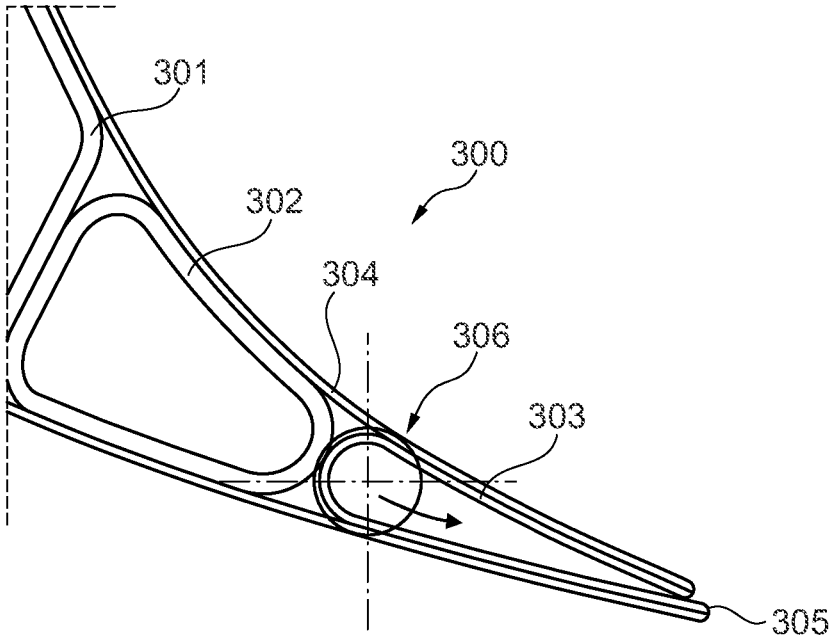
FIG. 3 is a schematic sectional view of a trailing edge portion of an example CMC aerofoil in which reinforcing fibres of a tubular CMC core extend to the trailing edge of the aerofoil.

FIG. 3 shows a sectional view of a trailing edge portion of an aerofoil 300 comprising multiple tubular internal CMC cores 301, 302, 303 and an outer CMC layer 304 surrounding the internal CMC cores 301, 302, 303. Each of the tubular CMC cores 301, 302, 303 comprises ceramic fibres (not shown) within a ceramic matrix, with the ceramic fibres extending along the walls of the tubes 301, 302, 303. The fibres may for example be in the form of woven fibre mats embedded within a ceramic matrix. Tubular cores 301, 302 are in the form of closed tubes in which the fibres extend around the tube walls, whereas tubular core 303 is an open tube, in which the ceramic fibres in the wall of the core 303 extend to the trailing edge 305 of the aerofoil 300. This arrangement allows for cooling air within the tubular core 303 to be directed more closely to the trailing edge 305 of the aerofoil without having to reduce the minimum diameter of curvature 306 of the tubular core 303.

Figure 4:
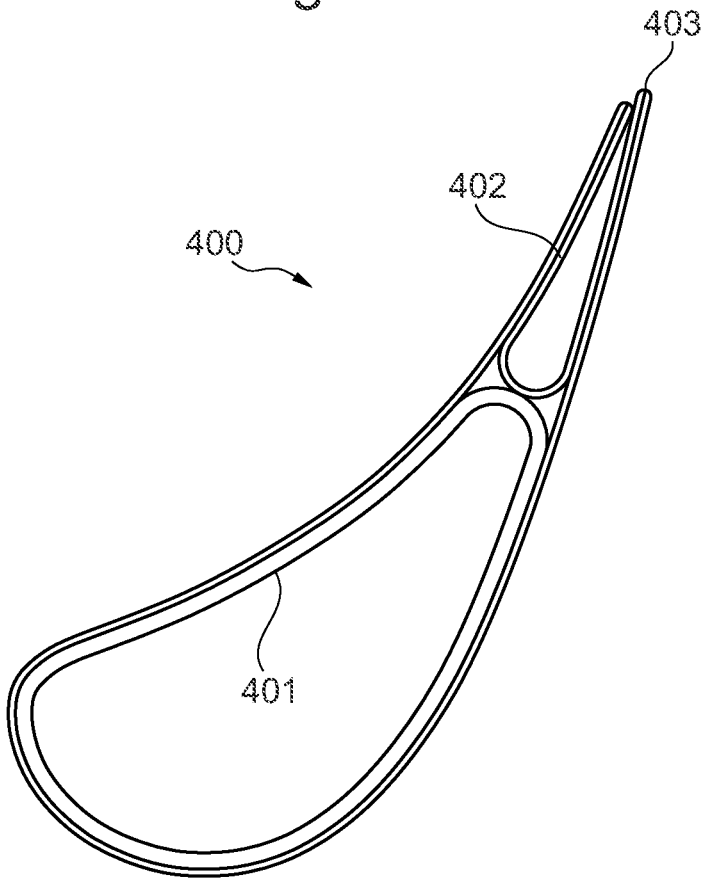
FIG. 4 is a schematic sectional view of an example aerofoil having two internal cores.
Figure 5:
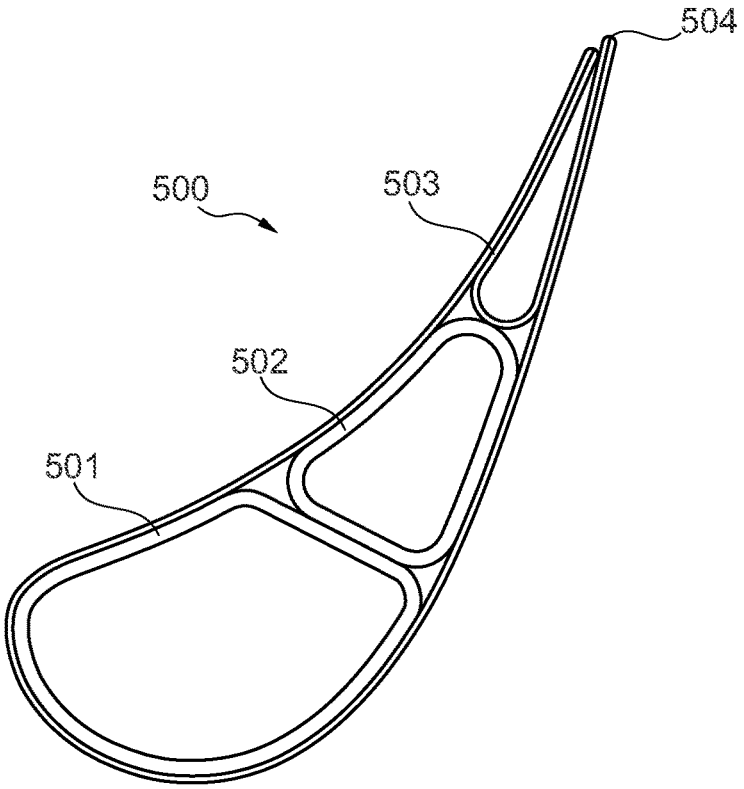
FIG. 5 is a schematic sectional view of an example aerofoil having three internal cores.

The number of internal cores in the aerofoil may vary from a minimum of two upwards. FIG. 4 shows an example of an aerofoil 400 with two internal cores 401, 402, in which one core 402 has fibres that extend to a trailing edge 403 of the aerofoil 400. FIG. 5 shows an alternative example of an aerofoil 500 having three internal cores 501, 502, 503, one of which 503 has fibres extending to a trailing edge 504 of the aerofoil 500. In each case the aerofoil comprises first and second tubular CMC cores that extend along a longitudinal axis of the aerofoil (i.e. in a direction orthogonal to the page in FIGS. 4 and 5), and an outer CMC layer surrounding the first and second tubular CMC cores, the outer CMC layer defining an outer shape of the aerofoil having leading and trailing edges, wherein fibres within a wall of the second tubular CMC core extend to the trailing edge of the aerofoil.

Figure 6:
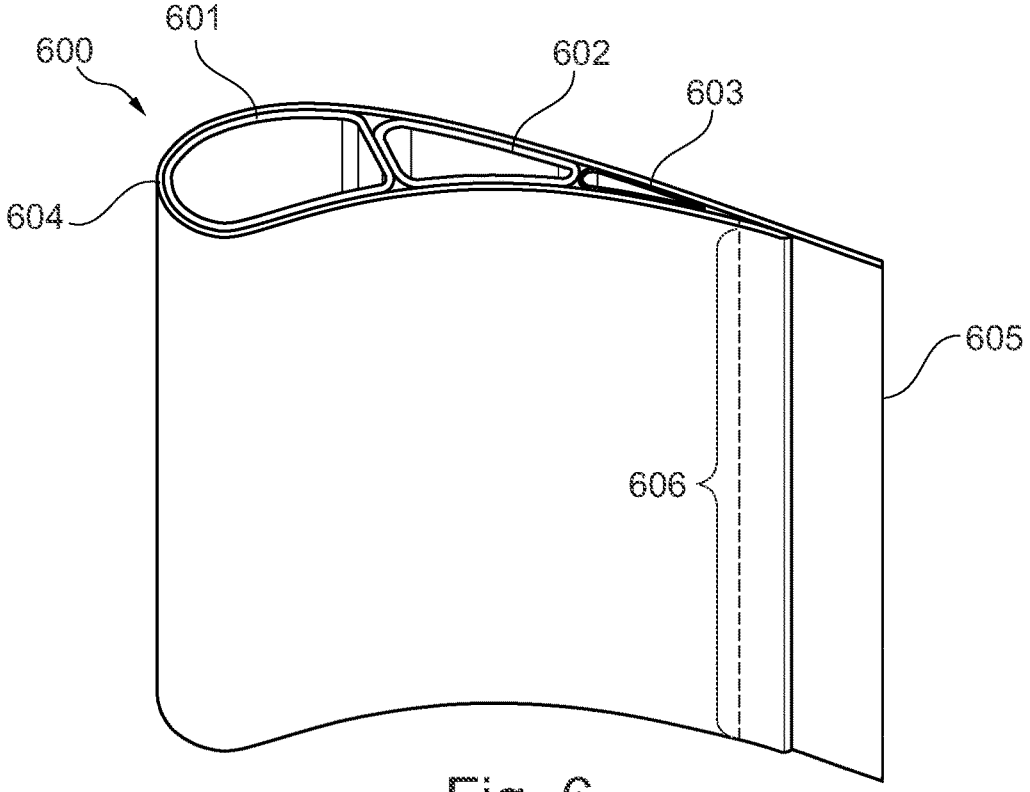
FIG. 6 is a perspective view of the aerofoil of FIG. 5.

FIG. 6 shows a perspective view of an example aerofoil 600 of the type shown in FIG. 5, i.e. with two closed internal cores 601, 602, one open internal core 603 and an outer layer 604 surrounding the internal cores 601, 602, 603. Fibres in the open internal core 603 extend to a trailing edge 605 of the aerofoil 600. Air cooling passages are provided by holes 606 machined along an inner concave external surface 607 of the aerofoil 600. Cooling air can thereby pass along the bore of the internal core 603 and out of the aerofoil through the holes 606. Due to the passage of air along the outer surface of the aerofoil when in use, the cooling air will be swept along the external surface of the aerofoil towards the trailing edge 605.

Figure 7:
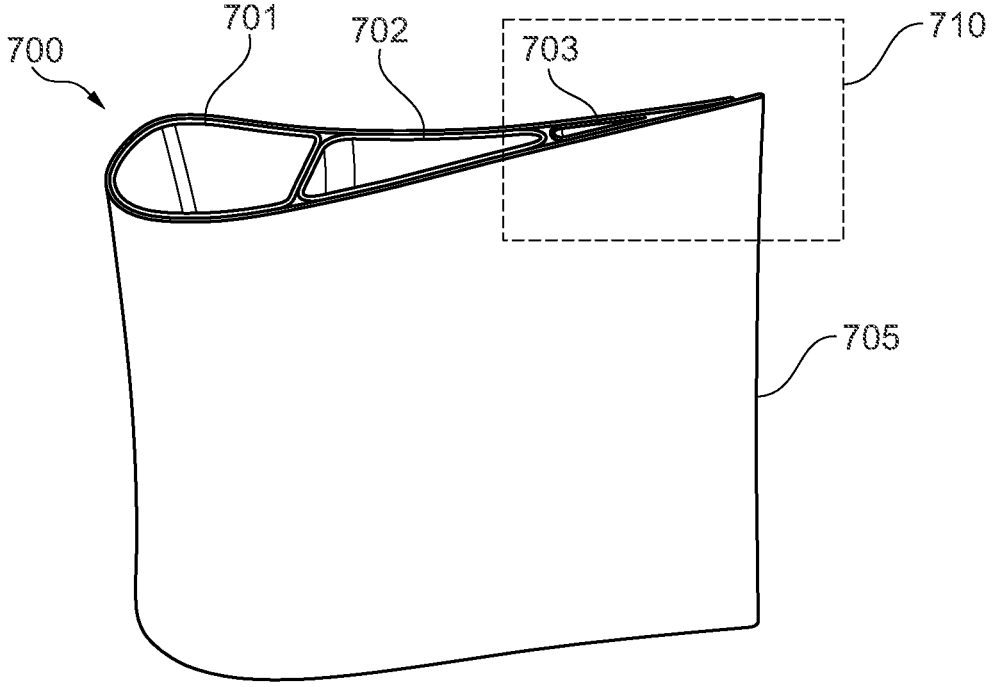
FIG. 7 is a perspective view of an example aerofoil having a cooling slot proximate its trailing edge.
Figures 8A, 8B:
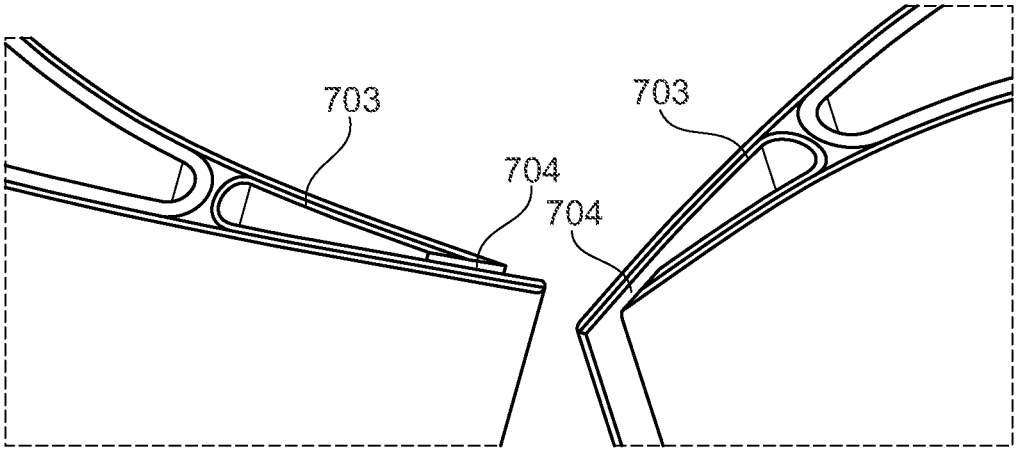
FIGS. 8*a* and 8*b* are detailed views of the trailing edge portion of the aerofoil of FIG. 7.
Figure 9A:
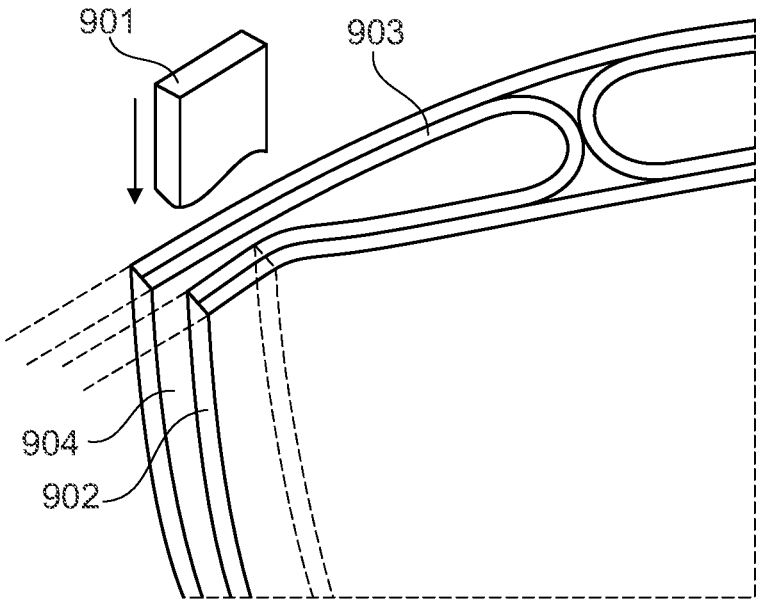
FIG. 9*a* is a sketch of a trailing edge portion of an example aerofoil, indicating a position of an insert tool.
Figure 10:
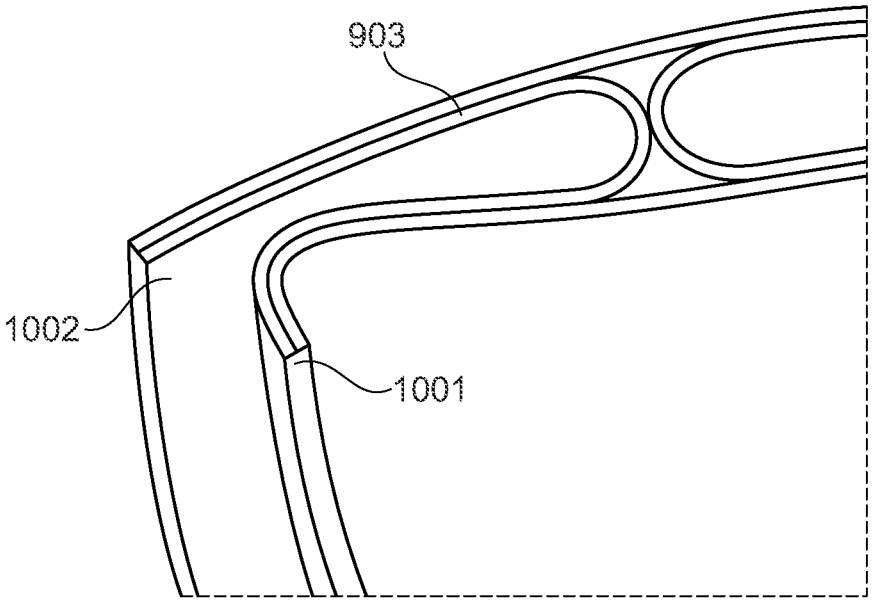
FIG. 10 is a sketch of a trailing edge portion of an example aerofoil, in which a portion proximate the trailing edge is curved to aid machining.
Figure 11:
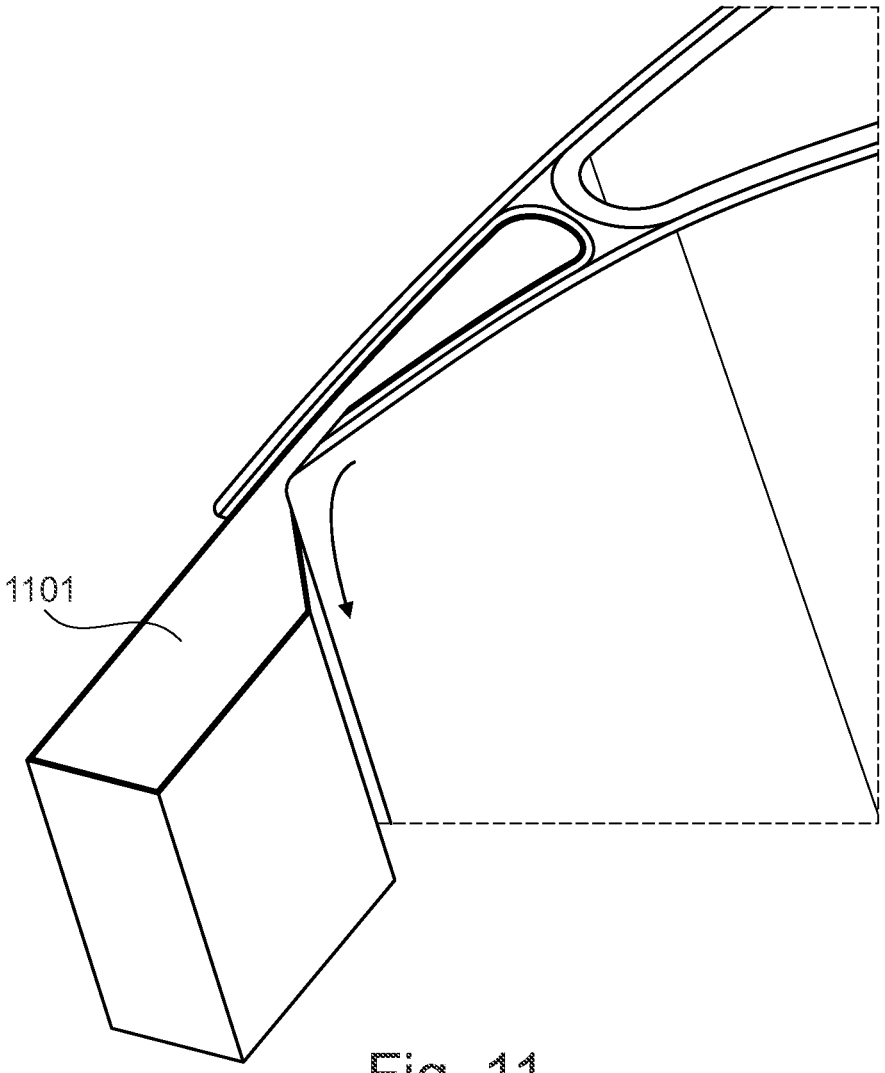
FIG. 11 is a sketch of a trailing edge portion of an example aerofoil, indicating a position of an insert tool.

FIG. 7 illustrates an alternative form of providing an air cooling passage for an aerofoil having an open internal core, with FIGS. 8*a* and 8*b* showing detailed views (within the box 710 defined in FIG. 7) of the aerofoil. The aerofoil 700 comprises two closed internal cores 701, 702 and one open internal core 703. An air cooling passage is provided by a gap 704 between adjacent internal faces of the open internal core 703. The gap 704 may extend along the entire length of the trailing edge 705 of the aerofoil. In other examples the gap 704 may be intermittent, providing a plurality of air cooling passages connecting an internal volume of the internal core 703 with an external surface of the aerofoil 700. If the gap extends along the entire length, or along a substantial proportion thereof, it may be prone to closing up either during fabrication or use. During fabrication, an insert 901 may be provided to prevent the gap from closing up, for example as illustrated schematically in FIG. 9*a*. The dotted lines in FIG. 9*a* indicate material that may be machined away following consolidation of the CMC components of the aerofoil. As can be seen in this schematic drawing, an edge 902 of the internal core 903 will need to be machined away close to an adjacent face 904 of the internal core 903. This may result in the adjacent face 904 being machined to cause fibres within the internal core being exposed parallel or at shallow angles to the surface, resulting in a large surface area exposing interfacial regions between the fibres and surrounding matrix. During use, this could result in progressive damage to the CMC core 903 due to oxidation, for example if the composite is based on silicon carbide fibres in a silicon carbide matrix. To address this issue, the shape of the internal core 903 may be adjusted in the green (i.e. unconsolidated) state, as shown schematically in FIG. 10. Instead of having the internal faces of the trailing edges of the internal core 903 being parallel to each other prior to consolidation, one of the edges 1001 is curved away from the other face 1002 so that, after consolidation, a machining operation can effect removal of this curved edge, resulting in the aerofoil having a trailing edge portion of the type illustrated in FIG. 11. In this drawing, an insert 1101, which may be composed of a high temperature material such as graphite, is shown in place following a machining operation to remove the curved edge from the internal core and the outer layer. After removal of the insert 1101 the gap provided by the opening between adjacent faces of the internal core can serve as an air cooling passage.

Figure 12A:
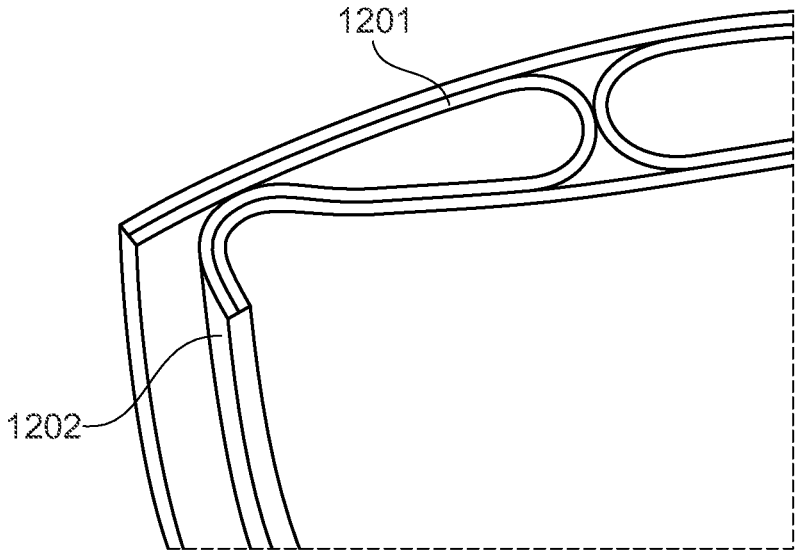
FIG. 12*a* is a sketch of a trailing edge portion of an example aerofoil, in which a portion proximate the trailing edge is curved to aid machining.
Figure 12B:
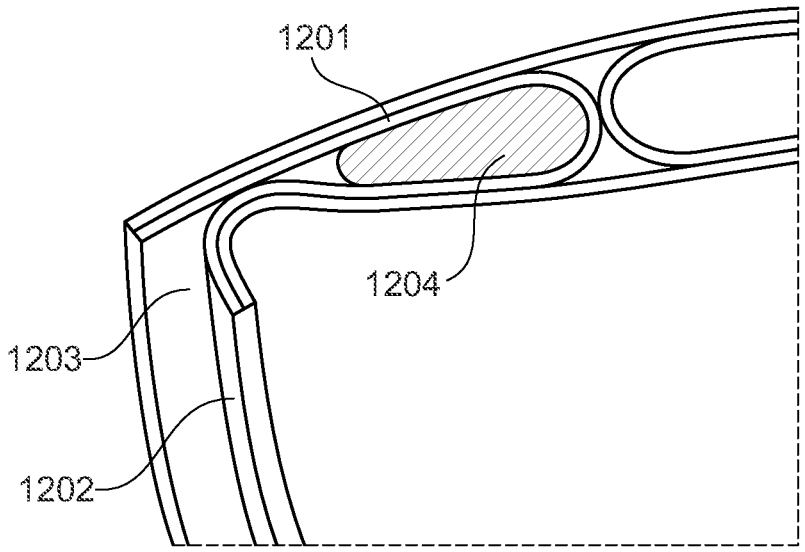
FIG. 12*b* is a sketch of a trailing edge portion of an example aerofoil similar to that in FIG. 12*a*, in which an internal tool is provided within an internal core.

FIGS. 12*a* and 12*b* illustrate an alternative form for the internal core 1201, in which adjacent facing portions of the internal core are joined together, rather than having a gap between them as in the preceding examples. As with the example in FIG. 10, a curved portion 1202 of the internal core 1201 allows for a machining operation to be applied after consolidation to remove the curved portion 1202 without affecting the adjacent facing portion 1203 of the internal core 1201. FIG. 12*b* shows an insert 1204 in place within the bore of the internal core 1201 to keep the shape of the core 1201 during consolidation.

Figure 13A:
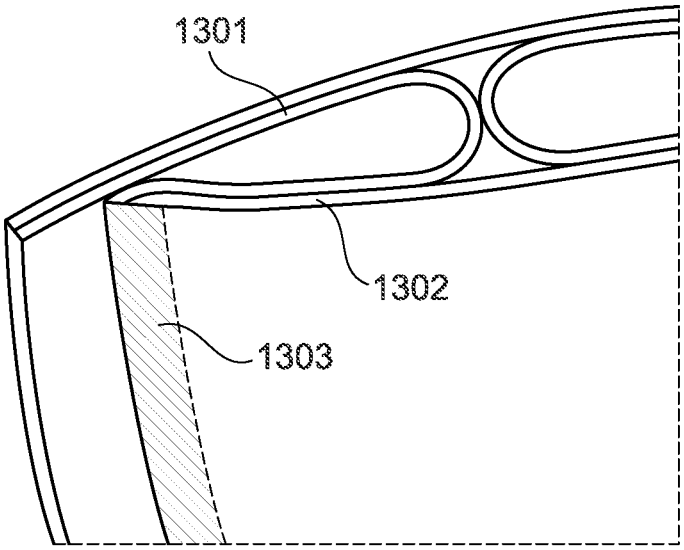
FIG. 13*a* is a sketch of the example aerofoil of FIG. 12*a* or 12*b* after a machining operation.
Figure 13B:
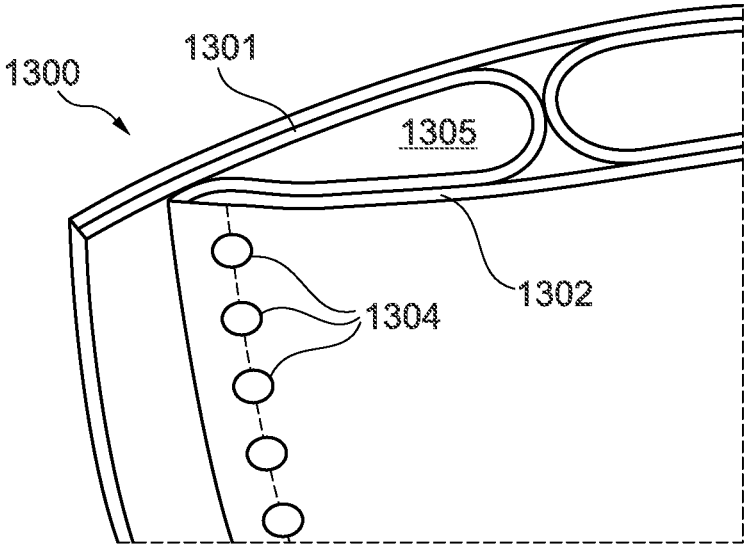
FIG. 13*b* is a sketch of the example aerofoil of FIG. 13*a* after a further machining operation to introduce cooling holes through the internal core and outer layer.

FIG. 13*a* shows a sketch of the aerofoil trailing edge portion of FIGS. 12*a* and 12*b* following a machining operation, which results in a machined surface 1303 of the internal core 1301 and outer layer 1302. A further machining process may be applied to form air cooling passages, as for example shown in FIG. 13*b*. The air cooling passages are in the form of holes 1304 passing through the wall of the internal core 1301 and outer layer 1302, the holes connecting an inner volume 1305 of the internal core 1301 to an external surface of the aerofoil 1300.

Figure 14A:
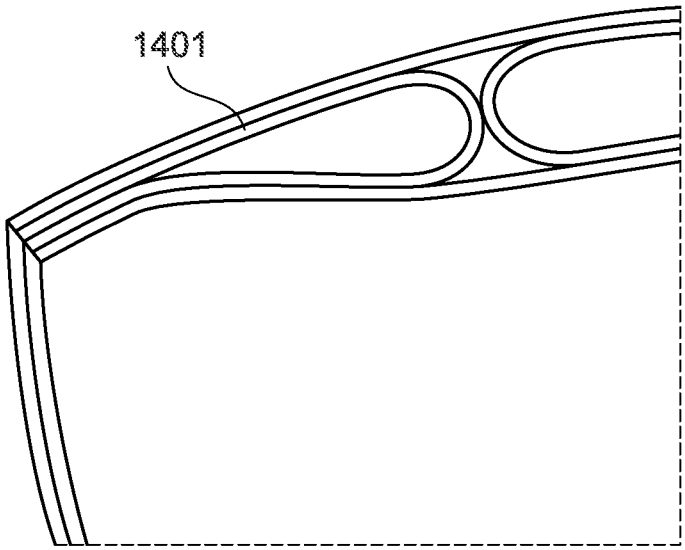
FIG. 14*a* is a sketch of a trailing edge portion of an alternative example aerofoil.
Figure 14B:
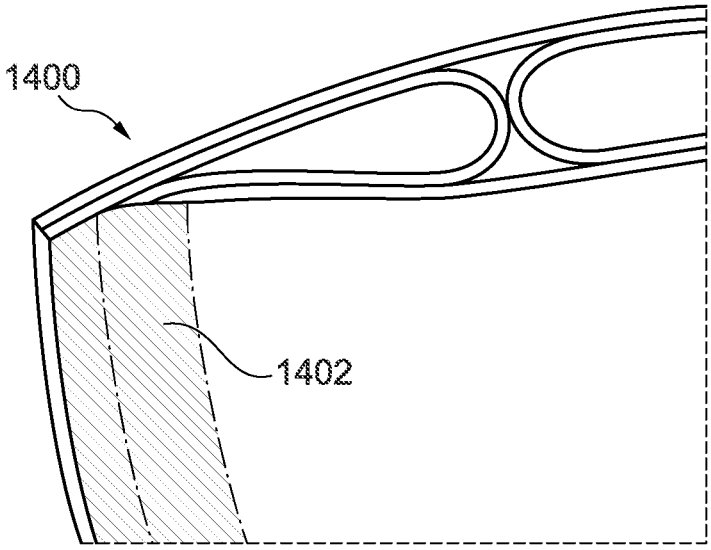
FIG. 14*b* is a sketch of the aerofoil of FIG. 14*a* following a machining operation.

FIGS. 14*a* and 14*b* illustrate an alternative example, in which adjacent trailing edge facing portions of the internal core 1401 are bonded together. Following consolidation, one face is machined away, resulting in a machined surface 1402 along the trailing edge of the aerofoil 1400.

Figure 15:
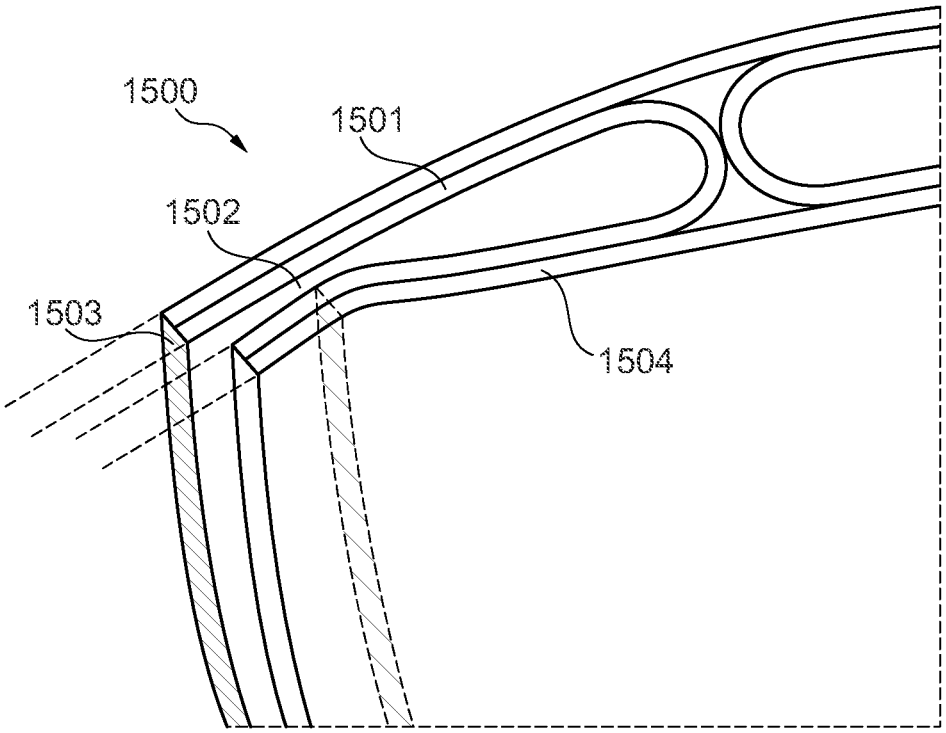
FIG. 15 is a sketch of a trailing edge portion of a further alternative example aerofoil.

FIG. 15 illustrates a further alternative example, in which adjacent trailing edge facing portions of the internal core 1501 are separated by a gap 1502 proximate the trailing edge 1503 of the aerofoil 1500. The trailing edges of the internal core 1501 and the outer layer 1504 are machined back after consolidation.

Figure 16:
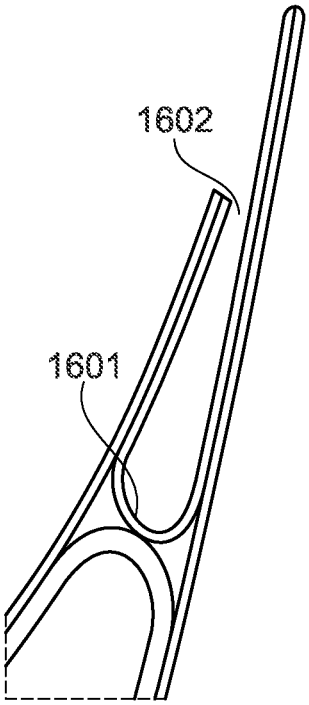
FIG. 16 is a sectional view of a trailing edge portion of an example aerofoil having cooling channels proximate the trailing edge.
Figure 17:
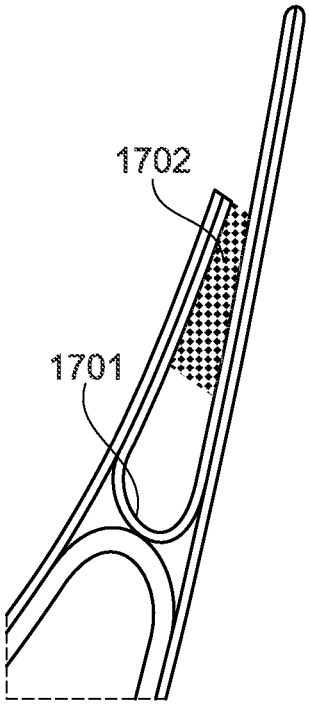
FIG. 17 is a sectional view of a trailing edge portion of an example aerofoil having cooling channels proximate the trailing edge formed within a ceramic foam.
Figure 18:
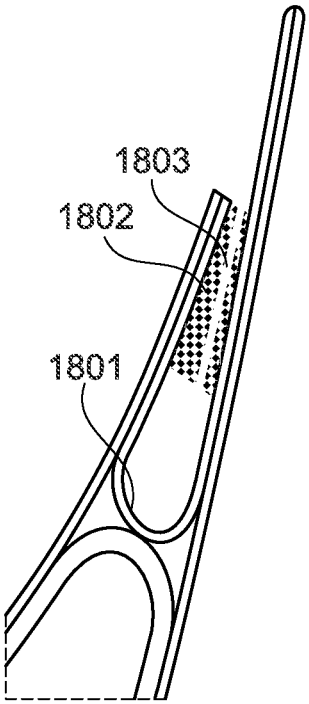
FIG. 18 is a sectional view of a trailing edge portion of an example aerofoil having cooling channels proximate the trailing edge formed by channels provided within a ceramic foam.
Figure 19:
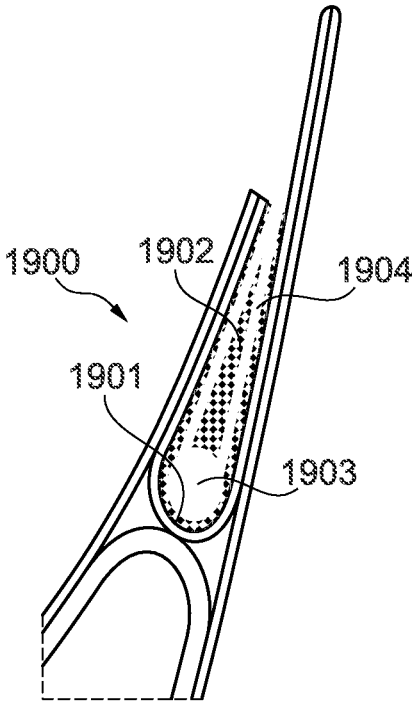
FIG. 19 is a sectional view of a trailing edge portion of an alternative example aerofoil having cooling channels proximate the trailing edge formed by channels provided within a ceramic foam.

FIGS. 16 to 19 illustrate various options for providing air cooling channels connecting an inner volume of the internal core to an external surface of the aerofoil. In each case the air cooling channels pass between adjacent facing portions of the internal core of the aerofoil. In FIG. 16, a gap 1602 between adjacent facing portions of the internal core 1601 is provided, through which cooling air passes. The gap 1602 may be continuous or intermittent along the trailing edge of the aerofoil. In FIG. 17, a ceramic foam insert 1702 is provided between adjacent facing portions of the internal core 1701. The ceramic foam may be open-celled, allowing cooling air to pass therethrough while maintaining a structural connection between the adjacent facing portions of the inner core 1701. If the ceramic foam is a closed-cell foam, or if greater airflow is required, air passages 1803 may be provided within the foam insert 1802, as shown in FIG. 18. An alternative form of ceramic foam insert 1902 is shown in FIG. 19, which fills the internal volume of the internal core 1901 and in which an air cooling passage or bore 1903 is provided along the longitudinal axis of the aerofoil, the bore 1903 connecting with a plurality of air cooling passages 1904 connecting the bore 1903 with the external surface of the aerofoil 1900.

Figure 20:
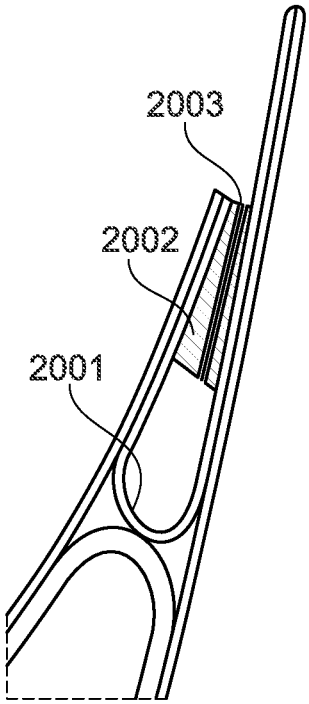
FIG. 20 is a sectional view of a trailing edge portion of an example aerofoil having cooling channels proximate the trailing edge formed by channels provided within an insert.
Figure 21:
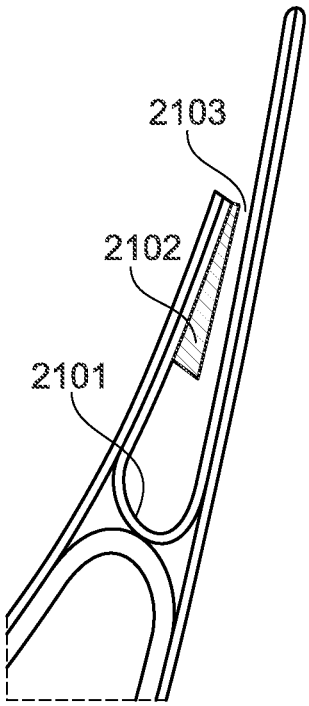
FIG. 21 is a sectional view of a trailing edge portion of an example aerofoil having cooling channels proximate the trailing edge formed by channels provided by an insert.

FIGS. 20 and 21 illustrate two further examples in which air cooling passages are provided between adjacent facing portions of the internal core. In these examples, an insert 2002, 2102 is provided between facing portions of the internal core 2001, 2101. In FIG. 20, the insert 2002 comprises a plurality of passages 2003 connecting the internal volume of the internal core 2001 to an external surface of the aerofoil. In FIG. 21, the insert 2102 comprises a series of gaps or recesses 2103 that allow air to flow between the insert and the internal core 2101.

Figure 22:
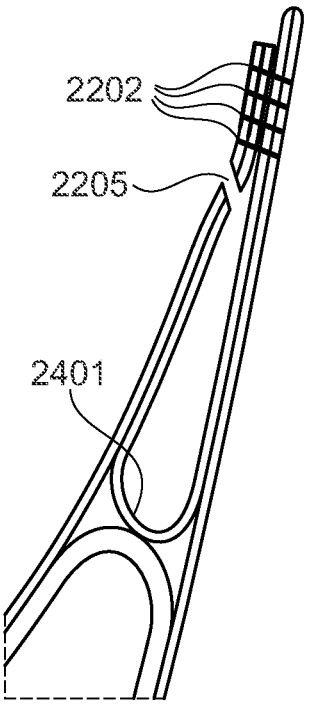
FIG. 22 is a sectional view of a trailing edge portion of an example aerofoil, in which bundles of reinforcing fibres are used to join together end portions of an internal core and an outer layer.
Figure 23:
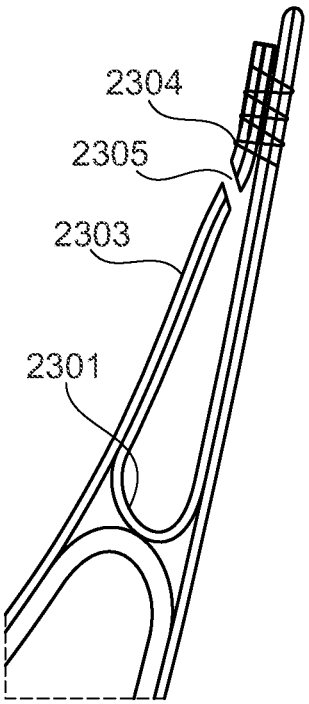
FIG. 23 is a sectional view of a trailing edge portion of an example aerofoil, in which reinforcing fibres are used to stitch together end portions of an internal core and an outer layer.

FIGS. 22 and 23 illustrate two alternatives for joining the adjacent facing portions of the internal core 2201, 2301, where air cooling passages pass through the wall of the internal core. In FIG. 22, pins 2202 are used to join together adjacent facing portions of the internal core 2201. The pins 2202 may be formed from bundles of fibres, which may have the same composition as fibres in the internal core, and provide an increased strength bond between the adjacent facing portions to reduce the risk of delamination. The pins 2202 may be introduced prior to consolidation of the CMC components by machining holes through the internal core 2201 and outer layer 2203 and inserting a pin 2202 into each machined hole. The consolidation process then forms a bond between the pins 2202 and the surrounding material. FIG. 23 illustrates an alternative example, in which the internal core 2301 and outer layer 2303 are stitched together using fibres 2304, or bundles of fibres, that pass through the layers and join them together. In both of the examples in FIGS. 22 and 23, machined holes 2205, 2305 are shown, through which air cooling passes from the internal volume of the internal core to an external surface of the aerofoil.

Figure 24:
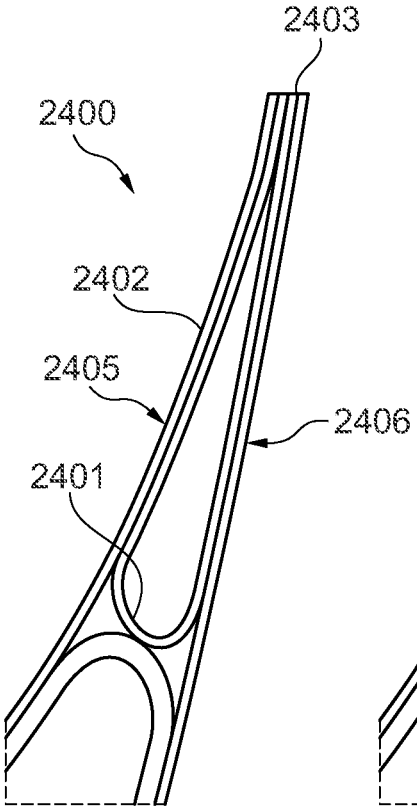
FIG. 24 is a sectional view of a trailing edge portion of an example aerofoil prior to a machining operation.
Figure 25:
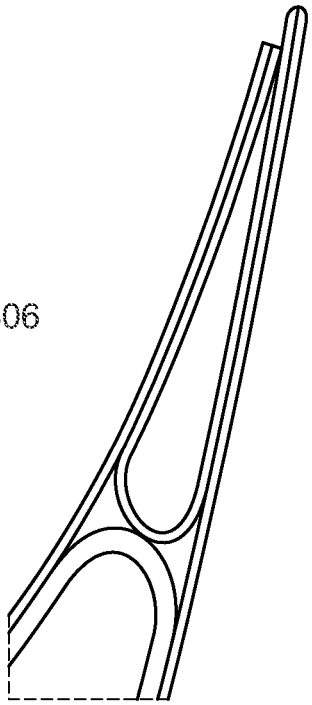
FIG. 25 is a sectional view of a trailing edge portion of the example aerofoil of FIG. 26 following a machining operation on the trailing edge.
Figure 26:
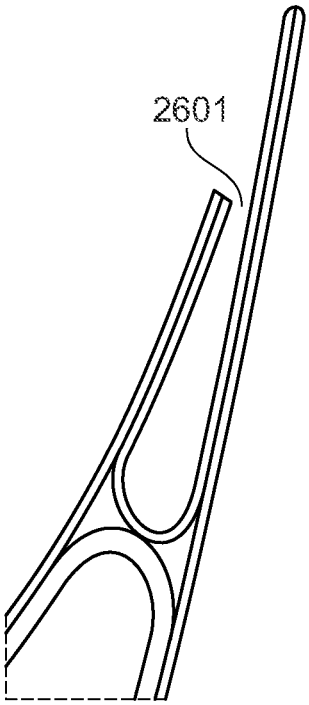
FIG. 26 is a sectional view of a trailing edge portion of the example aerofoil of FIG. 26 following a further machining operation on the trailing edge.

FIGS. 24, 25 and 26 illustrate examples showing how machining operations following consolidation can result in different forms of trailing edge portions of the aerofoil. In the pre-machined form, shown in FIG. 24, the internal core 2401 and outer layer 2402 are joined together at the trailing edge 2403 of the aerofoil 2400. Following a first machining operation, the trailing edge 2403 is machined back, with the edge of the internal core 2401 and outer layer 2402 machined back further on the inner concave surface 2405 of the aerofoil 2400 than on the outer convex surface 2406. In this configuration, the adjacent facing portions of the internal core 2401 are joined together. Air cooling passages may then provided by machining channels through the wall of the internal core 2401 and outer layer 2402. Machining further results in the form shown in FIG. 26, where a gap 2601 is formed between the adjacent facing portions of the internal core 2401, allowing one or more air cooling channels to be formed.

Figure 27:
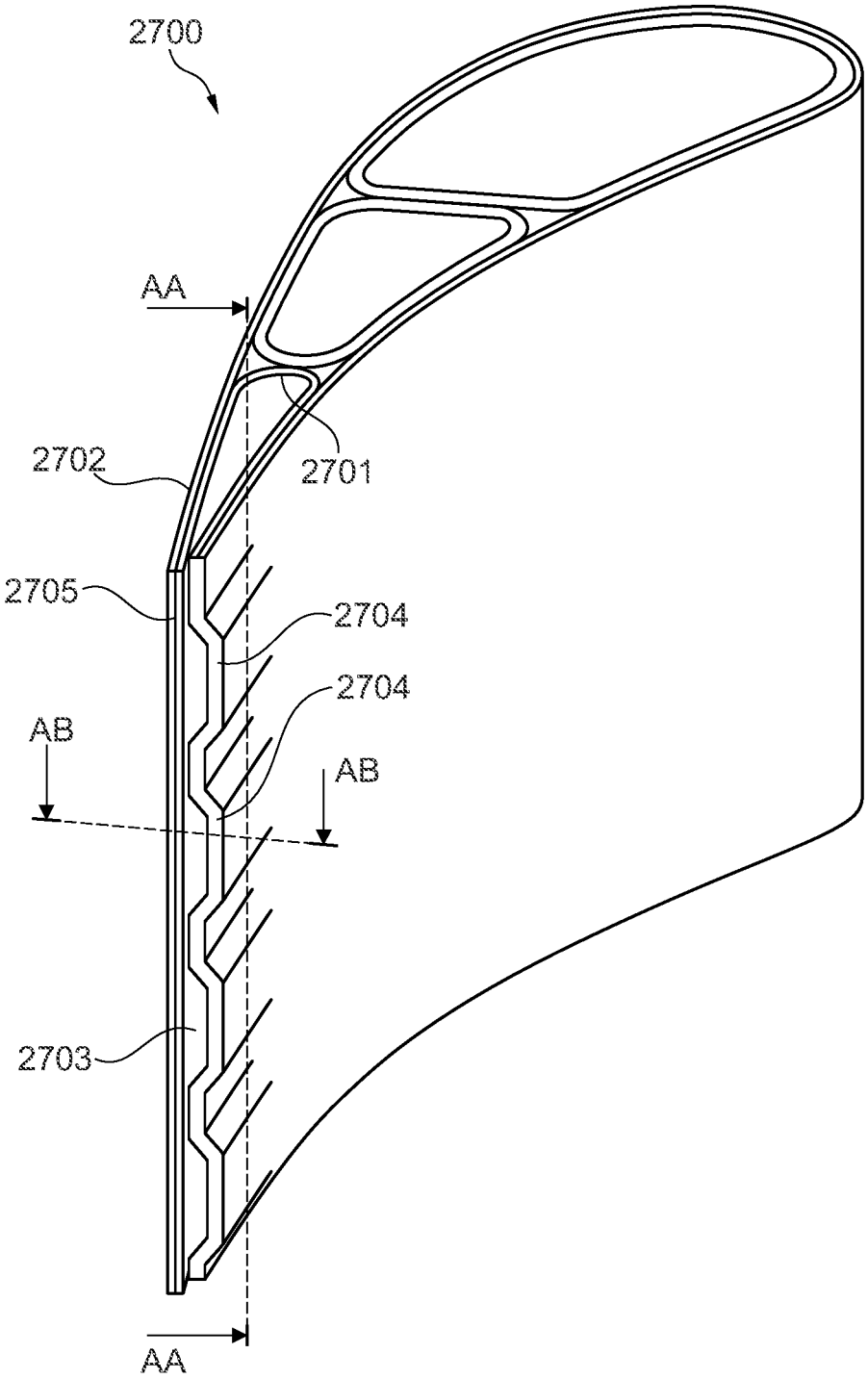
FIG. 27 is a sketch of an example aerofoil in which cooling channels are provided proximate a trailing edge by corrugations provided in an internal core and outer layer along the trailing edge.

FIG. 27 illustrates an example of an aerofoil 2700 in which gaps 2703 between adjacent facing portions of the internal core 2701 are provided by corrugations 2704 in the internal core 2701 and outer layer 2702, the corrugations 2704 extending along the trailing edge 2705 of the aerofoil 2700.

Figure 28:
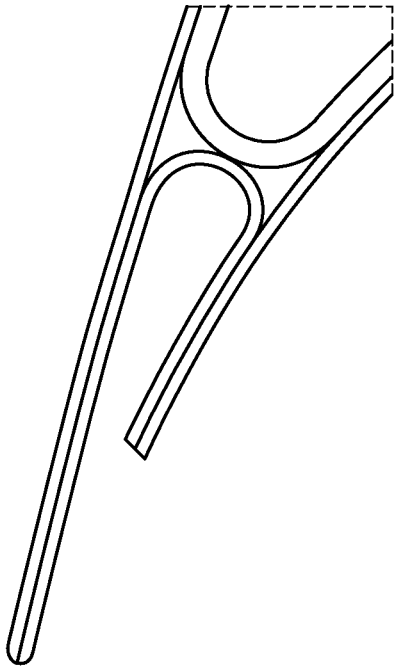
FIG. 28 is a sectional view along line AB-AB in FIG. 29, showing a cooling channel proximate the trailing edge.
Figure 29:
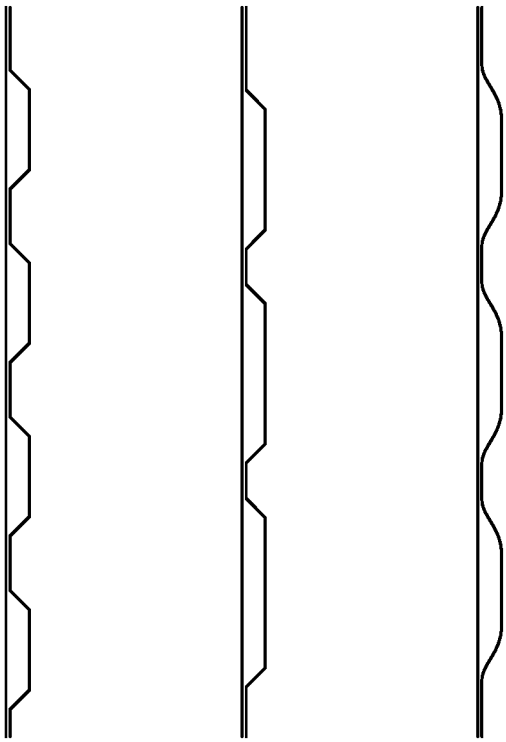
FIG. 29 shows three alternative examples of trailing edge cooling channels for an aerofoil of the type shown in FIG. 27.

FIG. 28 is a detailed sectional view along section AB-AB shown in FIG. 27, and FIG. 29 shows three different example forms the corrugations along AA-AA of FIG. 27 may take.

Figure 30:
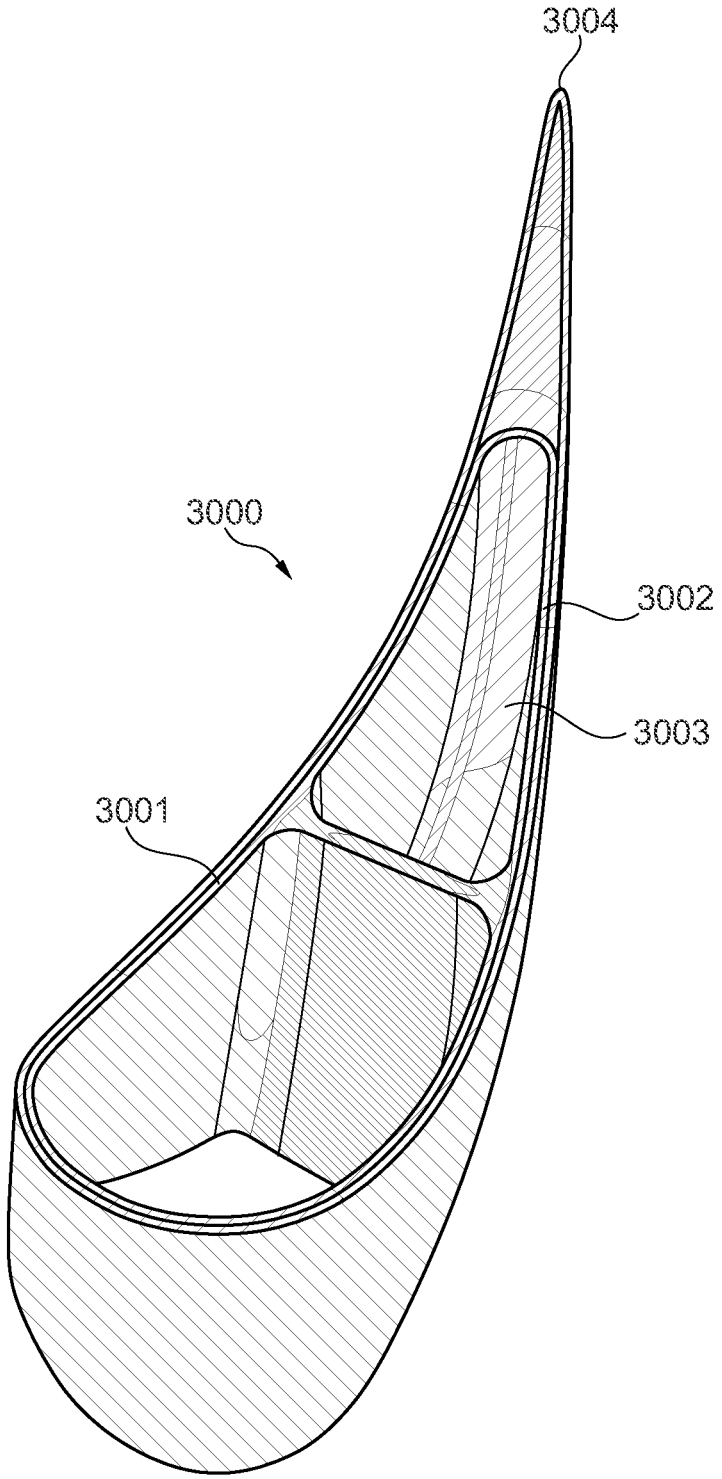
FIG. 30 is an output of a computer model temperature simulation for an aerofoil having internal cores and an outer layer.
Figure 31:
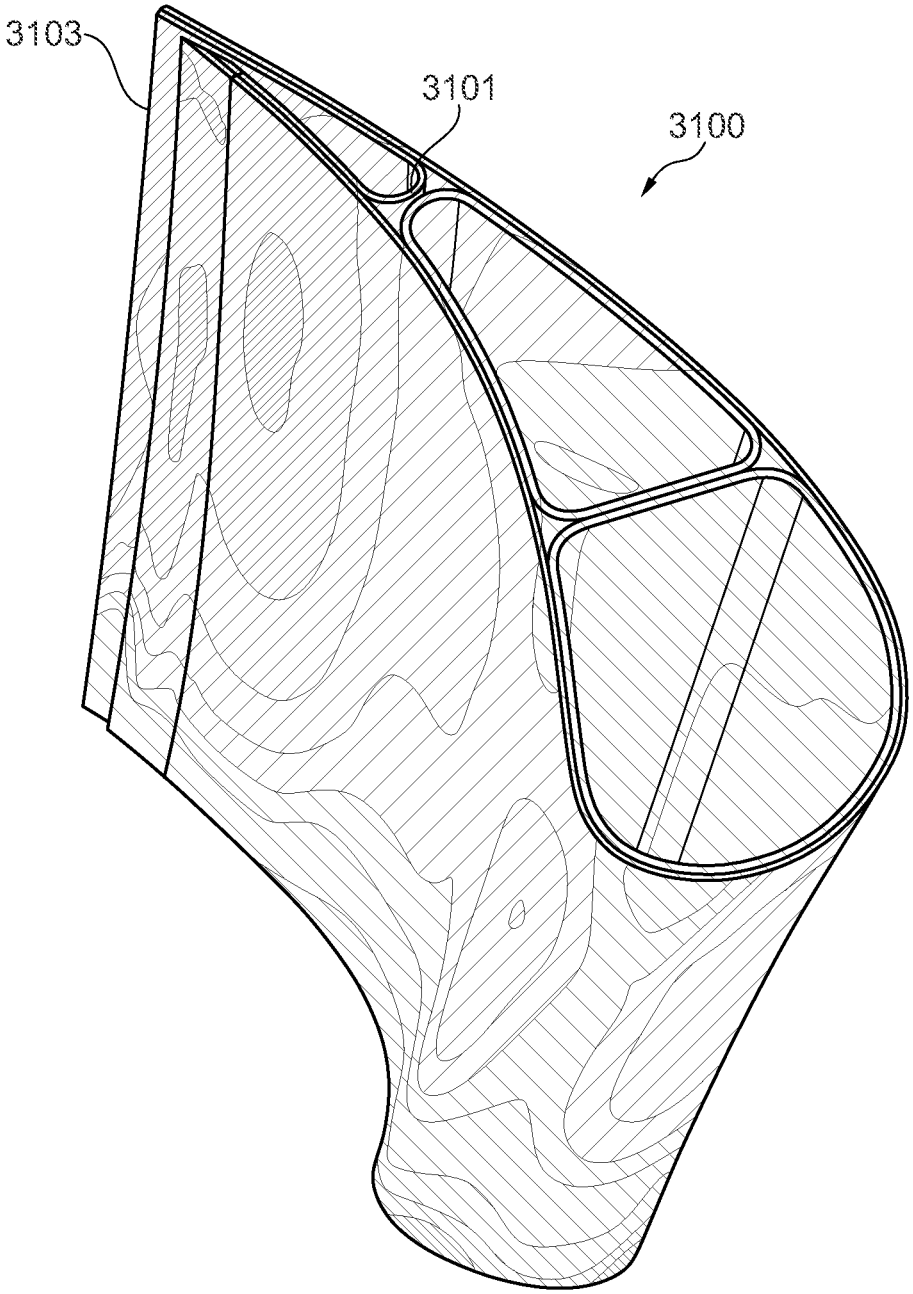
FIG. 31 is an output of a computer model temperature simulation for an aerofoil having internal cores and an outer layer, in which air cooling passages are provided proximate the trailing edge.

FIG. 30 illustrates an example CMC aerofoil 3000 having a type of construction in which the internal cores 3001, 3002 are of closed tubular form. As discussed above, the minimum radius allowed for such cores results in any air flowing from cooling passages (not shown) connecting the internal volume 3003 of the core 3002 closest to the trailing edge 3004 of the aerofoil 3000 to the external surface of the aerofoil 3000 being too far away to provide effective cooling at the trailing edge 3004. Computer simulations of the aerofoil 3000 show that the temperature of the aerofoil reaches a maximum at the trailing edge 3004, which limits the maximum use temperature of the aerofoil 3000. By comparison, as shown in FIG. 31, simulation of an example aerofoil 3100 having an internal core 3101 in which fibres extend to the trailing edge 3103 of the aerofoil 3100 and in which one or more air cooling passages are provided proximate the trailing edge show a more uniform temperature, demonstrating that air cooling is more effective when provided closer to the trailing edge 3103.

Figure 32:
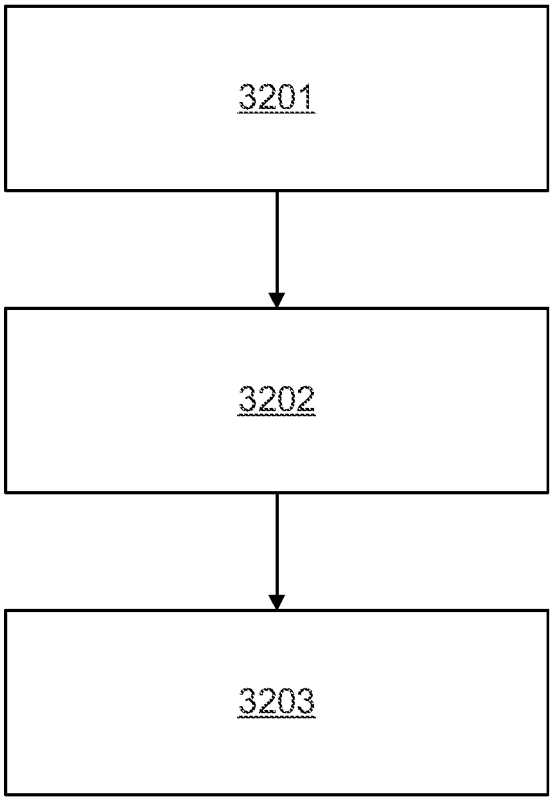
FIG. 32 is a flowchart illustrating an example method of forming a CMC aerofoil.

A CMC aerofoil according to the examples illustrated above may be formed according to the process illustrated in FIG. 32. In a first step 3201, first and second CMC internal cores are provided. The first and second cores may be formed for example by laying up fibres around a mandrel and impregnating the fibres with a ceramic or ceramic precursor. A silicon carbide CMC may for example be formed by laying up SiC fibres and binding the fibres together with a binder. An oxide CMC may be formed by laying up oxide fibres, for example alumina-based fibres, and impregnating the fibres with a slurry of oxide particles with a binder. Following impregnation of the fibres, the first and second tubular CMC cores are surrounded by an outer CMC layer (step 3202) to define an outer shape of the aerofoil having leading and trailing edges. At this stage, fibres in the wall of the second tubular CMC core extend to the trailing edge of the aerofoil. The assembled aerofoil is then subjected to a consolidation step 3203, in which the matrix around the fibres is densified to form the final CMC aerofoil. Subsequent machining steps may be applied, for example to machine the trailing edge and/or form air cooling passages connecting an inner volume of the second tubular CMC core to an external surface of the aerofoil.

The invention claimed is:

1. An aerofoil comprising:

first and second tubular Ceramic Metal Composite (CMC) cores extending along a longitudinal axis of the aerofoil; and an outer CMC layer surrounding the first and second tubular CMC cores and defining an outer shape of the aerofoil having leading and trailing edges, wherein fibres within a wall of the second tubular CMC core extend to the trailing edge of the aerofoil.

2. The aerofoil of claim 1, comprising one or more air cooling passages connecting an inner volume of the second tubular CMC core to an external surface of the aerofoil.

3. The aerofoil of claim 2, wherein the aerofoil comprises an inner concave external surface and an outer convex external surface, a plurality of air cooling passages connecting the inner volume of the second tubular CMC core to the inner concave external surface.

4. The aerofoil of claim 2, wherein a plurality of air cooling passages pass through a wall of the second tubular CMC core.

5. The aerofoil of claim 2, wherein the one or more air cooling passages are defined by one or more gaps between adjacent facing portions of the inner surface of the second tubular CMC core.

6. The aerofoil of claim 5, comprising an insert between the adjacent facing portions of the inner surface of the second tubular CMC core.

7. The aerofoil of claim 5, wherein a plurality of air cooling passages are defined by corrugations of the inner surface of the second tubular CMC core.

8. The aerofoil of claim 6, wherein a plurality of air cooling passages are defined by passages within the insert.

9. The aerofoil of claim 8, wherein the insert comprises a ceramic foam.

10. The aerofoil of claim 9, wherein the insert comprises plenums forming the plurality of air cooling passages.

11. A method of forming a CMC aerofoil, comprising the steps of:

providing first and second tubular CMC cores;

surrounding the first and second tubular CMC cores with an outer CMC layer to define an outer shape of the aerofoil having leading and trailing edges, wherein fibres within a wall of the second tubular CMC core extend to the trailing edge of the aerofoil; and consolidating the first and second CMC cores with the outer CMC layer to form the CMC aerofoil.

12. The method of claim 11, comprising the step of forming one or more air cooling passages connecting an inner volume of the second tubular CMC core to an external surface of the aerofoil.

13. The method of claim 12, wherein the aerofoil comprises an inner concave external surface and an outer convex external surface, the method comprising forming a plurality of air cooling passages connecting the inner volume of the second tubular CMC core to the inner concave external surface.

14. The method of claim 12, comprising forming a plurality of air cooling passages passing through a wall of the second tubular CMC core.

15. The method of claim 12, wherein the one or more air cooling passages are defined by one or more gaps between adjacent facing portions of the inner surface of the second tubular CMC core.

16. The method of claim 15, comprising providing an insert between the adjacent facing portions of the inner surface of the second tubular CMC core.

17. The method of claim 15, comprising forming a plurality of air cooling passages by corrugations of the inner surface of the second tubular CMC core.

18. The method of claim 16, wherein a plurality of air cooling passages are defined by passages within the insert.

19. The method of claim 1, wherein the insert comprises a ceramic foam.

20. The method of claim 19, wherein the insert comprises plenums forming the plurality of air cooling passages.

* * * * *